US007406398B2

(12) United States Patent
Ollre et al.

(10) Patent No.: US 7,406,398 B2
(45) Date of Patent: Jul. 29, 2008

(54) SYSTEM AND METHOD FOR DETERMINING PUMP UNDERPERFORMANCE

(75) Inventors: Albert G. Ollre, Sugar Land, TX (US); Jan Dolejsi, Oxford (GB); Antonio Vizurraga, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 846 days.

(21) Appl. No.: 10/840,568

(22) Filed: May 6, 2004

(65) Prior Publication Data

US 2005/0251362 A1 Nov. 10, 2005

(51) Int. Cl.
*G06F 11/30* (2006.01)

(52) U.S. Cl. ..... 702/182

(58) Field of Classification Search ..... 702/182
See application file for complete search history.

(56) References Cited

U.S. PATENT DOCUMENTS 3,908,761 A * 9/1975 Patterson et al. ..... 166/250.01
5,329,465 A 7/1994 Arcella et al.
5,892,860 A 4/1999 Maron et al.
5,941,305 A 8/1999 Thrasher et al.
6,092,598 A 7/2000 Breit
6,167,965 B1 1/2001 Bearden et al.
6,260,004 B1 7/2001 Hays et al.
6,330,525 B1 12/2001 Hays et al.
6,368,068 B1 4/2002 Corlew et al.
6,721,683 B2 * 4/2004 Harris et al. ..... 702/183
2005/0165581 A1 * 7/2005 Roba et al. ..... 702/182

* cited by examiner

*Primary Examiner*—Bryan Bui
*Assistant Examiner*—Jonathan Moffat
(74) *Attorney, Agent, or Firm*—Daryl R. Wright; Bryan P. Galloway

(57) ABSTRACT

A system and method are provided for identifying underperformance in a pumping system used to produce a desired fluid. Various conditions are sensed during operation of the pumping system, and those sensed conditions are used to determine measured parameters that are provided with an associated confidence factor. The measured parameters in conjunction with the confidence factors are compared to a reference composite curve for the specific pumping system to determine whether actual performance has satisfied underperformance criteria or moved across a threshold into underperformance.

24 Claims, 8 Drawing Sheets

SYSTEM AND METHOD FOR DETERMINING PUMP UNDERPERFORMANCE

BACKGROUND OF THE INVENTION

1. Field of the Invention

The present invention relates to artificially lifted oil wells, and in particular to the determination of underperforming submersible pumping systems.

2. Description of Related Art

In many artificially lifted wells, pumping systems are used to produce a desired fluid, e.g. petroleum, to a collection point. For example, a wellbore may be drilled to a subterranean reservoir, and the pumping system is used to lift fluid from the reservoir location to the collection point. In many applications, pumps are used to intake fluid from the wellbore and to pump the fluid upwardly or laterally through the wellbore via either tubing or the annulus formed between a pumping system deployment mechanism and the surrounding wellbore wall. During extended operation, pumping system components may be subject to degradation or breakage leading to underperformance of the overall pumping system.

Attempts have been made to detect such underperformance of the system. However, accurate determination of the onset of underperformance relative to the actual potential on a specific system has proved difficult.

BRIEF SUMMARY OF THE INVENTION

In general, the present invention provides a method and system of accurately determining underperformance of a specific pumping system. This enables a well field manager to accurately identify underperforming assets and/or predict catastrophic failure. The manager is then able to, for example, remove pumping systems, service equipment, plan for replacement of pumping systems, or take other intervening actions based on the intervention cost and/or production potential of a given well.

BRIEF DESCRIPTION OF THE DRAWINGS

Certain embodiments of the invention will hereafter be described with reference to the accompanying drawings; wherein like reference numerals denote like elements, and.

DETAILED DESCRIPTION OF THE INVENTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for determining when pumping systems are not performing according to their expected or reference performance levels. The process enables a well operator or well field manager to better manage production through identification of specific systems that are underperforming. For example, the determination may be made for electric submersible pumping systems by accurately evaluating the expected performance of one or more individual pumps that constitute the pump unit for each submersible pumping system.

Figure 1:
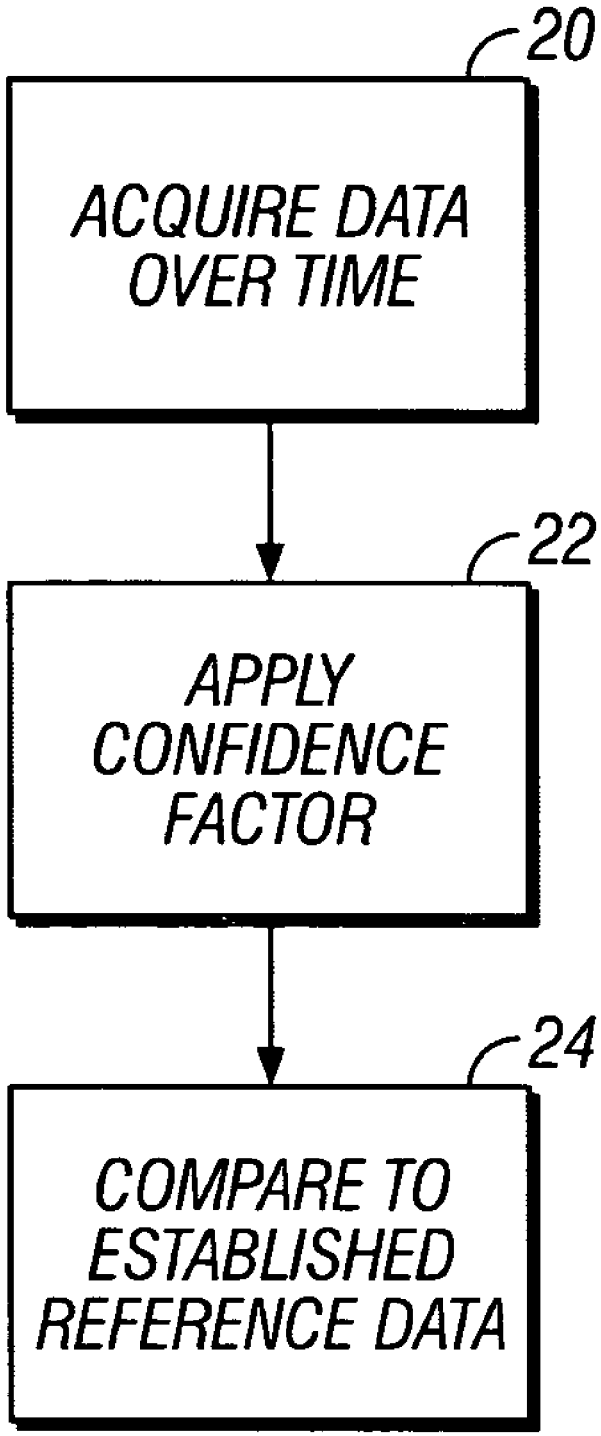
FIG. 1 is a schematic illustration of a methodology for determining underperformance of a well, according to an embodiment of the present invention.

A general approach to determining underperformance is set forth in the flowchart of FIG. 1. For example, data related to the performance of a specific pumping system is acquired over time and used to provide a trended parameter line, as set forth in block 20. The data can be acquired, for example, on a real time or an episodic basis. Depending on the methodology used to obtain data on the performance of the specific pumping system, different confidence factors are applied to the trended parameter line, as illustrated by block 22. Selected parameters, based on the acquired data, can then be compared to established reference data/parameters for the specific pump unit, as illustrated in block 24. This comparison enables a well field manager to determine whether the specific pumping system has satisfied underperformance criteria, for example crossed an underperformance threshold. Appropriate planning and/or corrective actions can then be taken, as discussed more fully below.

Figure 2:
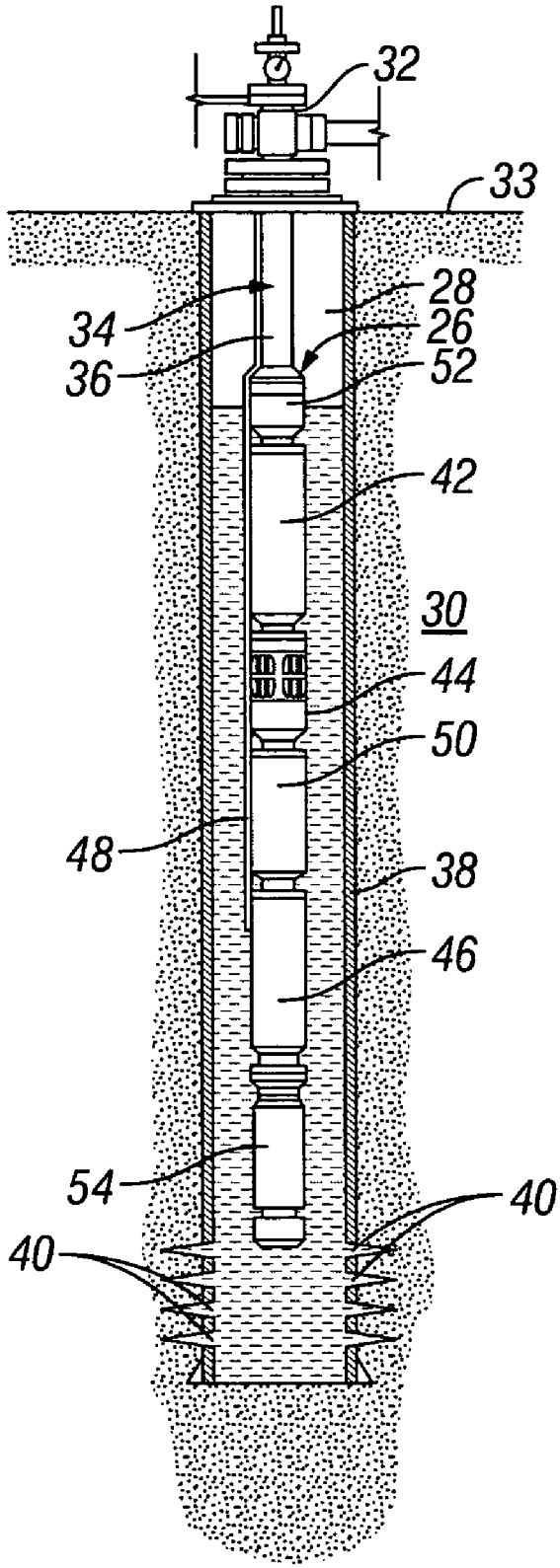
FIG. 2 is an elevation view of an electric submersible pumping system utilized in a well to lift fluids to a surface location, according to an embodiment of the present invention.

Although this general approach can be applied to a variety of pumps and pumping systems, the present description will primarily be related to the determination of underperformance for pump units utilized in an electric submersible pumping system. In FIG. 2, an embodiment of an electric submersible pumping system 26 is illustrated. In this embodiment, pumping system 26 is disposed in a wellbore 28 drilled or otherwise formed in a geological formation 30. Electric submersible pumping system 26 is suspended below a wellhead 32 disposed, for example, at a surface 33 of the earth. Pumping system 26 is suspended by a deployment system 34, such as production tubing, coiled tubing, or other deployment system. In the embodiment illustrated, deployment system 34 comprises tubing 36 through which well fluid is produced to wellhead 32.

As illustrated, wellbore 28 is lined with a wellbore casing 38 having perforations 40 through which fluid flows between formation 30 and wellbore 28. For example, a hydrocarbon-based fluid may flow from formation 30 through perforations 40 and into wellbore 28 adjacent electric submersible pumping system 26. Upon entering wellbore 28, pumping system 26 is able to produce the fluid upwardly through tubing 36 to wellhead 32 and on to a desired collection point.

Although electric submersible pumping system 26 may comprise a wide variety of components, the example in FIG. 2 is illustrated as having a submersible pump unit 42, a pump intake 44, and an electric motor 46 that powers submersible pump 42. Submersible pump unit 42 may comprise a single or multiple pumps coupled directly together or disposed at separate locations along the submersible pumping system. In many applications, submersible pump unit 42 comprises one to five pumps.

Motor 46 receives electrical power via a power cable 48 and is protected from deleterious wellbore fluid by a motor protector 50. In addition, pumping system 26 may comprise other components including a connector 52 for connecting the components to deployment system 34. Another illustrated component is a sensor unit 54 utilized in sensing a variety of wellbore parameters. It should be noted, however, that a variety of sensor systems can be deployed along electric submersible pumping system 26, casing 38, or other regions of the wellbore to obtain data for determining one or more desired parameters, as described more fully below. Furthermore, a variety of senior systems can be used at surface 33 to obtain desired data helpful in the process of determining measured parameters related to operation of the pumping system.

Figure 3:
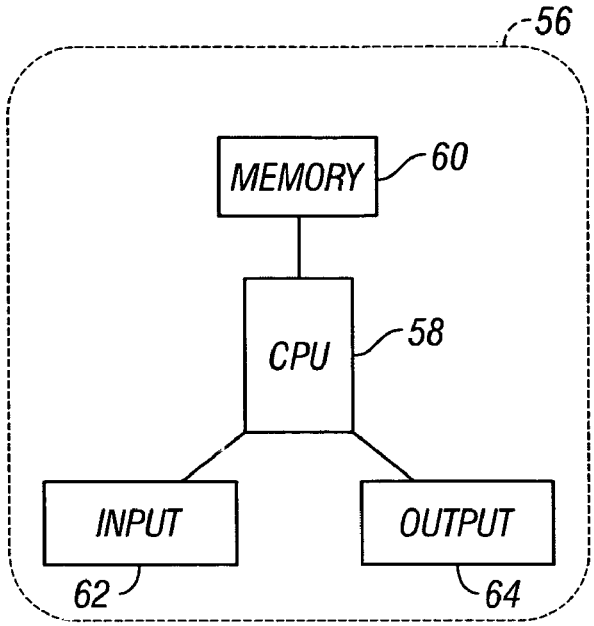
FIG. 3 is a diagramatic representation of an automated system that can be utilized to acquire and manipulate data, according to an embodiment of the present invention.

Some or all of the methodology outlined with reference to FIG. 1 may be carried out by an automated system 56, such as the processing system diagramatically illustrated in FIG. 3. Automated system 56 may be a computer-based system having a central processing unit (CPU) 58. CPU 58 is operatively coupled to a memory 60, as well as an input device 62 and an output device 64. Input device 62 may comprise a variety of devices, such as a keyboard, mouse, voice-recognition unit, touchscreen, other input devices, or combinations of such devices. Output device 64 may comprise a visual and/or audio output device, such as a monitor having a graphical user interface. Additionally, the processing may be done on a single device or multiple devices at the well location, away from the well location, or with some devices located at the well and other devices located remotely.

In determining underperformance of a pumping system, reference values are determined with respect to expected performance of the specific pump unit. General performance standards or performance averages for a certain type of pump do not serve as very accurate reference points when determining whether a specific pumping system is failing to perform as should be expected.

Figure 4:
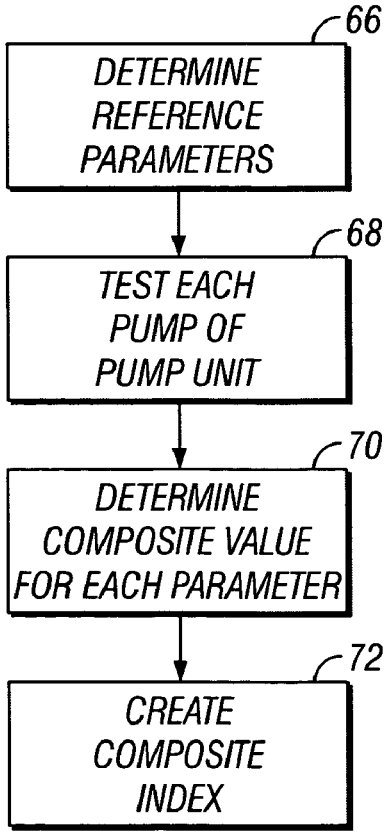
FIG. 4 is a flowchart of a methodology embodiment for establishing composite reference data for a specific system, such as the pumping system illustrated in FIG. 2.

Accordingly, accurate reference values are determined for a specific pumping system by testing the specific pumps of, for example, the pump unit 42 of a given pumping system. A procedure for establishing the reference values/parameters is illustrated by the flowchart of FIG. 4.

Initially, parameters are determined that will be used as the reference parameters for comparison to the corresponding actual parameters measured during operation of the pumping system, as illustrated by block 66. Examples of reference parameters that can be used include pump unit lift, flow rate, and power.

Once the parameters are determined, each pump of pump unit 42 is tested to determine reference values for each of the desired parameters, e.g. lift, flow rate, power, as illustrated by block 68. Typically, the testing is done prior to use of the pump in an actual working application, e.g. at the factory. If the pump unit comprises multiple pumps, the parameter values for each pump are combined to determine a composite parameter, as illustrated by block 70. By way of example, the lift values from each pump are summed, the flow rate values for each pump are combined and averaged, and the power values for each pump are summed.

The composite values for each parameter are used to create a composite index, as illustrated by block 72. This composite index is, effectively, the reference parameters that establish the expected operational capability of the specific pumping system. In, for example, a well field with multiple wells and pumping systems, such a unique, composite index can be established for each pumping system that is to be deployed. The composite index may be constructed as and referred to as a composite tested curve.

Figure 5:
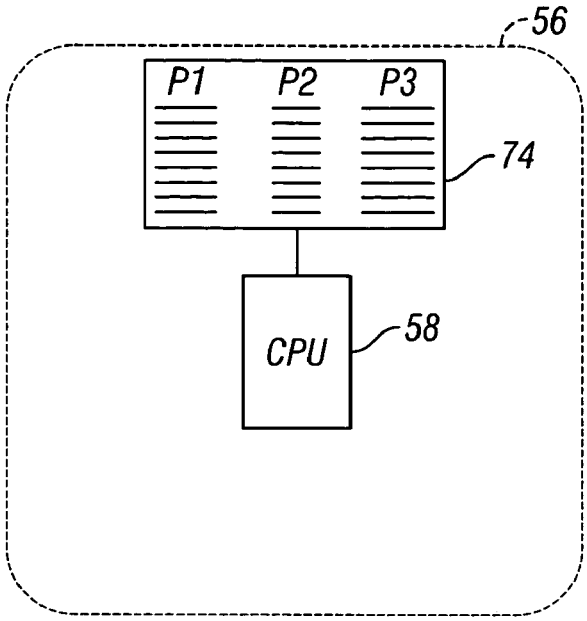
FIG. 5 is an illustration of a composite reference data module used to store reference data for use in the automated system illustrated in FIG. 3.

As illustrated in FIG. 5, the reference parameters may be derived and/or stored on automated system 56 in a reference parameter module 74. In the example illustrated, three parameters, P1, P2 and P3, are stored in module 74. Module 74 may be formed as part of memory 60, or the module may be disposed at a separate location while retaining communication with automated system 56.

Figure 6:
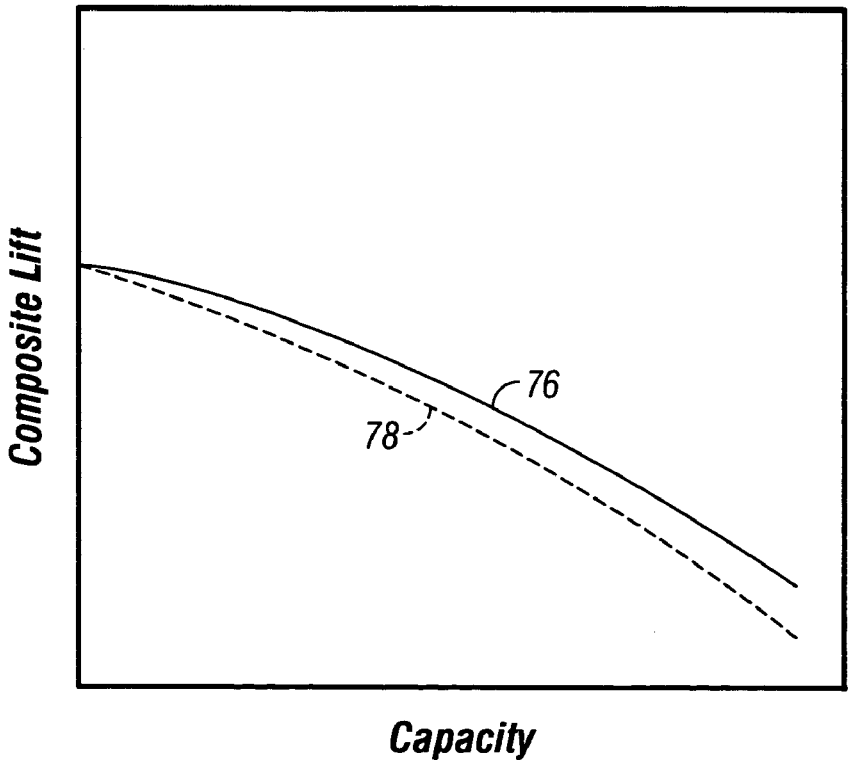
FIG. 6 is a graphical representation of a composite tested curve.

As further illustrated in FIG. 6, the reference parameters may be stored and/or displayed as a composite tested curve 76. In this example, the reference parameter is lift. The composite tested curve reflects the composite lift for a given pump unit 42 relative to flow capacity. As further illustrated by dashed threshold line 78, an underperformance threshold can be established for a given parameter. Thus, if lift for a given pump unit 42 decreases below threshold line 78, the pump unit is considered to have moved into a region of underperformance.

The most suitable reference parameters can be selected based on a variety of considerations, including pump type, ease of measurement, application environment and other considerations. Additionally, the data used in determining parameter values can be obtained, derived, stored and manipulated in a variety of ways, depending on factors such as available test equipment, environment and pump type. In one application, for example, data obtained from testing each pump is stored in vector format in a database, e.g. a database within module 74. The appropriate mathematical operations are then performed on the data to develop a composite vector. From the composite vector, coefficients are generated to mathematically represent the composite tested curve used as a reference for determining pump underperformance.

Once the composite reference parameters for a specific pumping system are established, the pump unit 42 and overall pumping system can be deployed in an actual production application. During operation, data is acquired based on actual, operational performance of the pumping system. The data can be acquired by a variety of methods utilizing, for example, various sensors. The data obtained from the various sensors is used to determine actual performance parameters corresponding to the reference parameters previously determined for the specific pumping system. Depending on the parameters and the sensors available in a given application, certain data collected may correspond fairly directly to a desired, measured parameter. In other instances, however, the data obtained is used to derive the measured parameters. Thus, the accuracy of a given measured parameter is influenced by the way in which data is collected to determine the given measured parameter. A corresponding confidence factor (see block 22 of FIG. 1) is applied to the measured parameters depending on the methodology and/or devices, e.g. sensor systems, used to obtain the data for determining the measured parameter.

Figure 7:
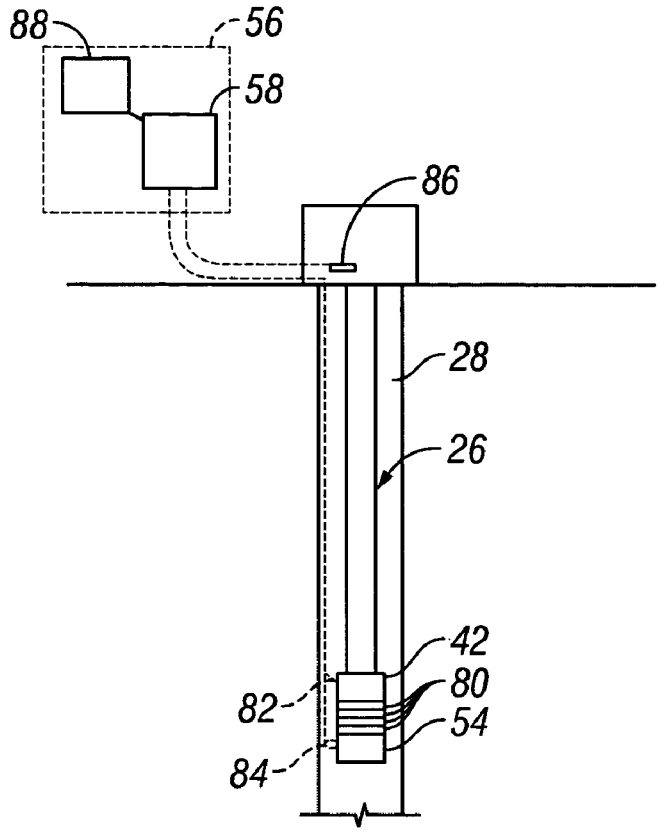
FIG. 7 is an illustration of a trending module for storing data received from various sensors that can be used in the automated system illustrated in FIG. 3.

In FIG. 7, a pumping system application is illustrated. In this application, pumping system 26 is deployed in wellbore 28, and pump unit 42 comprises a plurality of pumps 80. Additionally, sensors are employed to collect data during operation of pump unit 42. For example, sensor unit 54, downhole sensors 82, 84, and other sensors, such as wellhead sensor 86, can be utilized to collect data for determining desired, measured parameters.

In this embodiment, sensor unit 54, and sensors 82, 84, 86 are coupled to automated system 56, and data is transferred to a trending module 88. Trending module 88 uses data obtained from the various sensors to derive the measured parameters that will be compared to reference parameters, e.g. the composite tested curve, to determine whether the pumping system has moved into a region of underperformance. Of course, the actual operation of trending module 88 will depend on the types of sensors utilized as well as the desired parameters to be derived.

The data acquired by trending module 88 is acquired over time during operation of the pumping system. This enables the accumulation of data during extended operation of the system. The data can be used to create trended measured parameters that assist an operator in evaluating the performance of the pumping system 26 over an extended period of time, e.g. the operational life of the pumping system. The trended parameters also help the operator avoid being misled by instantaneous collection of data points having no context provided by the operational data trends. The data can be obtained in real time, on an episodic basis, or as a combination of real time and episodic sensor data.

Figure 8:
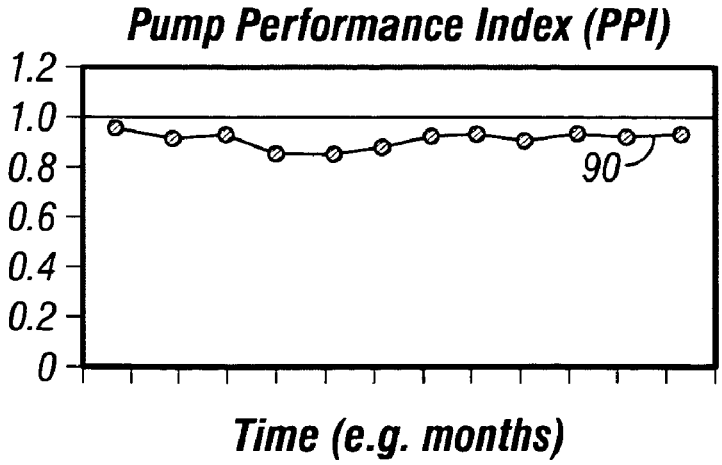
FIG. 8 is a graphical representation of a trend line reflecting actual, measured parameters for a specific pumping system.

In one embodiment of the present invention, the trended parameter or parameters is compared to the reference parameters to provide a pump performance index (PPI), as illustrated in FIG. 8. For example, if the parameter of interest is lift, the PPI can be defined as an analytical process that trends over time the comparison between the calculated hydraulic lift performance (based upon measured information from real time and episodic data, e.g. data obtained from sensor unit 54, and sensors 82, 84 and 86) and the factory tested performance (reference parameters) of the actual electric submersible pumping system deployed in wellbore 28. As described more fully below, however, actual use of the PPI is affected by the associated confidence factor used to quantify the viability of the calculations based on the types of sensory mechanisms and on the methodology used to obtain the measured data.

As illustrated in FIG. 8, the PPI values can be stored as a trend line 90 that embodies or incorporates the measured parameter obtained over time. The PPI values can be stored, for example, in trending module 88. However, the reliability of trend line 90 is affected by the devices and/or methodology used in collecting the data from which the measured parameters are determined.

For example, when utilizing a parameter, such as flow rate, actual measurement of the flow rate is highly reliable and therefore provides a high confidence factor. However, the reliability of the data, and hence the level of the confidence factor, decreases as the sensor data relies less on actual sensing of the desired parameter and more on various methodologies for deriving the parameter of interest from other types of sensor data. In determining, for example, discharge and intake pressures for pump unit 42, a multisensor able to directly measure discharge and intake pressure is highly reliable and demands a high confidence factor. If, however, the intake pressure can be directly measured, but the discharge pressure must be derived based on the other collected data, the reliability, and hence the confidence factor, is reduced. In other applications, it may be necessary to derive both the intake pressure and the discharge pressure. In one example, sensors are used to measure an acoustic fluid shot and to record wellhead pressure. From this collected data, the intake pressure and the discharge pressure both may be derived. However, the derived parameters/values are less reliable and are thus assigned a low confidence factor.

The confidence factor associated with a given measured parameter can vary from one time period to another depending on the sensors utilized and the specific data collected during tests performed on the well. For example, data on a given pumping system and well may be collected on a real time basis, and that data may be used to derive a given parameter over time to create a trend line. However, actual measurements of the given parameter may be taken on an episodic basis, thereby providing specific points along the trend line at which the confidence factor is very high.

Figure 9:
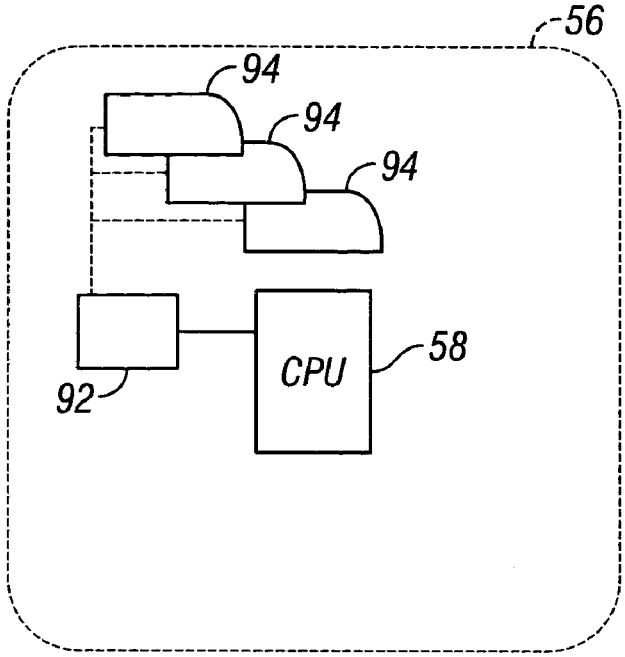
FIG. 9 is an illustration of a confidence factor module that can be used to store information related to confidence factors corresponding to measured parameters for use in the automated system illustrated in FIG. 3.

As illustrated in FIG. 9, one method for accumulating confidence factors associated with specific data collection systems is to store confidence factors in a confidence factor module 92. As illustrated, a variety of confidence factors 94 can be associated with different devices and methodologies for collecting data and determining measured parameters. Each of the confidence factors 94 is cataloged according to sensing methodology/sensory devices and stored in confidence factor module 92 of automated system 56.

Figure 10:
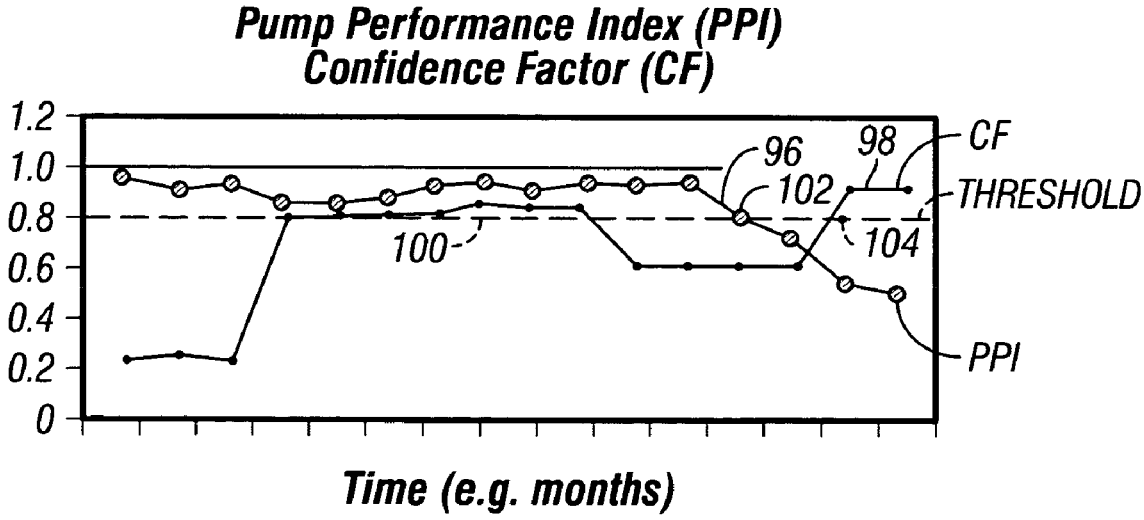
FIG. 10 is a graphical representation of a trend line reflecting confidence factors related to actual, measured parameters.

FIG. 10 graphically illustrates the use of confidence factors (CF) associated with a corresponding measured parameter trended over time (see trend line 96). In this example, the trended parameter is combined with the reference parameter to create PPI values. The confidence factors also are trended over time to match the trended PPI values (see confidence factor trend line 98). In other words, the confidence factor at a specific point in time is determined according to the devices/methodologies used for determining the measured parameter and PPI value at that specific point in time. In the graphical example, the level of the confidence factor changes over time due to different sensor systems or methodologies utilized in obtaining the data for determining specific PPI values. On the graph illustrated, the trended PPI data crosses a threshold line 100 into a region of underperformance at a crossover point 102. However, the confidence factor at crossover point 102 is moderately low. In contrast, the confidence factor is relatively high a short time thereafter at point 104. The PPI values are utilized in conjunction with the corresponding confidence factors to provide the well operator with a more accurate approach for determining well underperformance prior to taking any corrective actions. Based on the combined trend lines 96 and 98, for example, the determination of pumping system underperformance may be sometime after crossover point 102 based on the increasing confidence factor level and the continuation of PPI values below threshold line 100. The confidence factors effectively create a modified threshold line 100. However, the specific threshold modification resulting from the combination of confidence factor values and measured parameter values depends on the application environment, sensory devices utilized to obtain data, methodologies for determining the measured parameters, available options for corrective action, and the goals of the well operator.

It should be noted that the threshold crossing method described above is but one possible method of assessing pumping system performance, and those of skill in the art will recognize that other indicators may be used to determine when the pumping system has satisfied underperformance criteria. Furthermore, the slope of the trended PPI data may also be used to identify pumping system underperformance, either independently, or in combination with the confidence factors.

Figure 11:
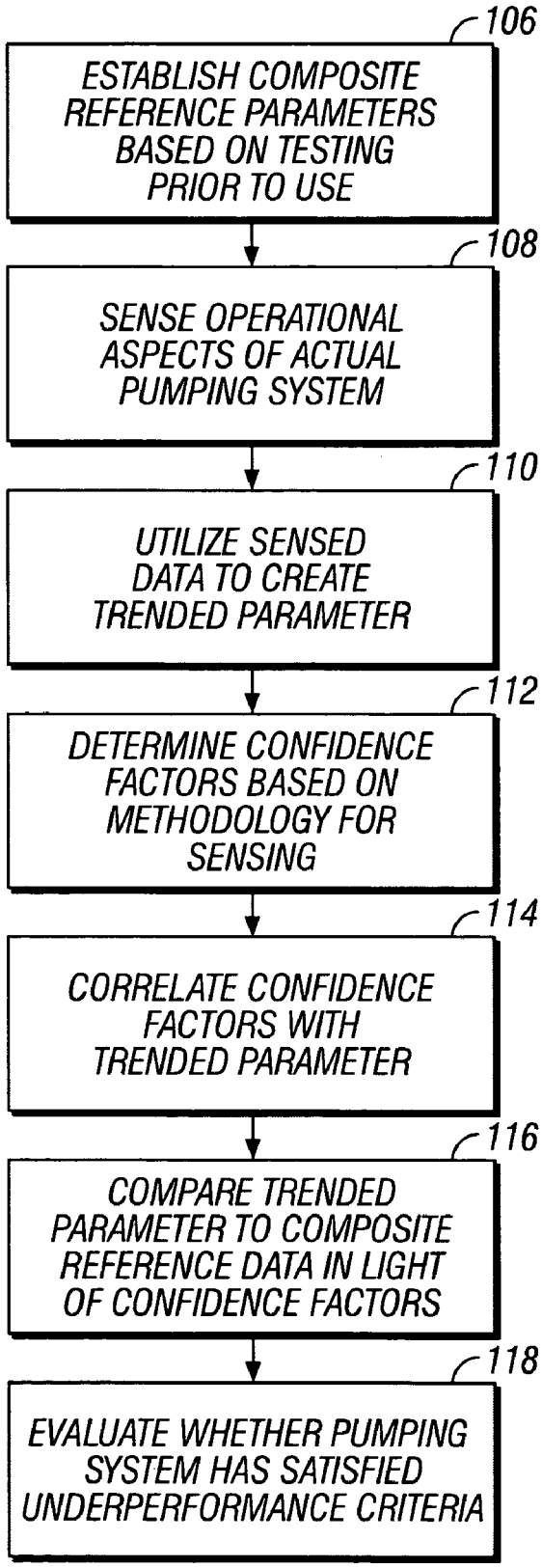
FIG. 11 is a flowchart representing implementation of the methodology for determining underperformance of a pumping system, according to an embodiment of the present invention.

In operation, the current methodology may be applied to each pumping system by initially establishing composite reference parameters, as illustrated by block 106 of FIG. 11. The composite reference parameters are selected and then determined based on testing of each pump in a given pump unit 42 before use. For example, each pump may be tested at the factory for a given parameter. The parameters of each pump in the pump unit are then combined to establish a composite reference parameter.

The operational aspects of the actual pumping system are then sensed once the pumping system is deployed and in operation (see block 108). The data acquired is then utilized to determine a measured parameter (or parameters), and the measured parameter is trended over time (see block 110). Confidence factors are assigned based on the methodology/devices for sensing the data used to determine the measured parameter (see block 112). The confidence factors are then correlated with corresponding measured parameters (see block 114). For example, a trend line of confidence factors may be created to correspond with the subject trended measured parameter, an example of which is illustrated in FIG. 10. In this example, the trended measured parameter is part of a PPI trend line which also accomplishes comparison of the measured parameter to the reference parameter. However, the confidence factors also can correspond to a measured parameter trend line that has not been converted to a PPI trend line.

Upon determining the trended parameter or parameters and the corresponding confidence factors, the trended parameter is compared to the composite reference data or parameters in light of the confidence factors (see block 116). The associated confidence factors provide a relatively direct indication of the reliability of the trended parameter or parameters. Automated system 56 may be designed to provide an alert, such as an audible or visual alert via output device 64, when pumping system performance has satisfied underperformance criteria. The use of confidence factors, with or without an automatic alert, enables accurate evaluation as to whether the pumping system has satisfied underperformance criteria, as illustrated by block 118. The well field manager is thus provided with a more accurate indication as to whether a pumping system is underperforming relative to the expected performance for that specific pumping system as determined by initial testing and derivation of reference parameters. As noted above, the use of confidence factors in conjunction with measured parameters can be accomplished by establishing PPI values that effectively compare measured parameters to reference parameters as a ratio.

Figure 12:
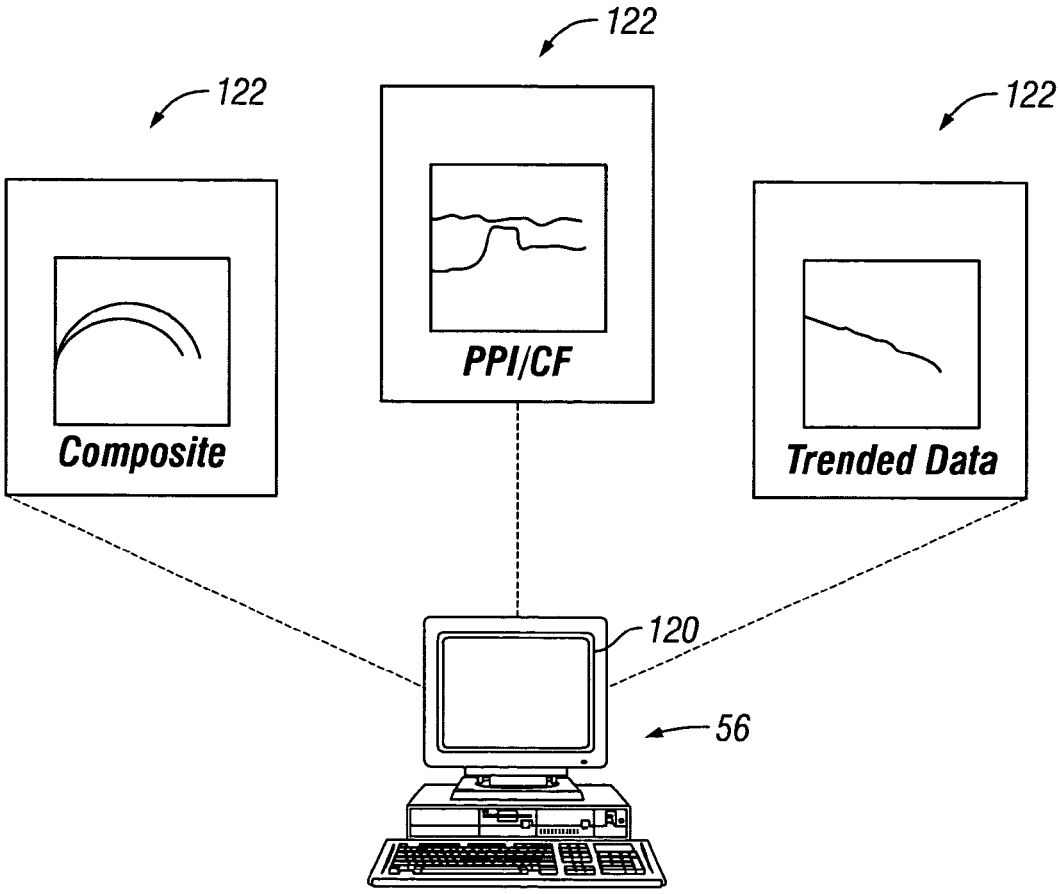
FIG. 12 is a representation of a graphical user interface that can be used with the automated system to compare measured parameters, in conjunction with the associated confidence factors, to composite reference parameters for a specific pumping system.

The use of automated system 56 enables the collection, storage, manipulation, and display of data and information. For example, information helpful to the well operator may readily be displayed via a graphical user interface 120, as illustrated in FIG. 12. Information is displayed graphically to facilitate the well field manager's use of relatively large amounts of data. The graphical user interface 120 potentially can display numerous screens 122 having several types of graphical displays. By way of example, the displays may include composite reference parameters for specific pumping systems; the corresponding graphs of measured parameters and confidence factors; a variety of trended data and other useful visual information. Regardless of the form of the output, the present system and methodology provides a usable, accurate way of determining whether a pumping system is underperforming relative to the expected performance for that specific pumping system.

Although, only a few embodiments of the present invention have been described in detail above, those of skill in the art will readily appreciate that many modifications are possible without materially departing from the teachings of this invention. Accordingly, such modifications are intended to be included within the scope of this invention as defined in the claims.

What is claimed is:

1. A method of identifying underperformance of a pumping system, comprising:

creating a reference composite curve for a parameter of the pumping system;

determining the parameter through actual measurements during operation of the pumping system;

providing a confidence factor based on the methodology of determining the parameter through actual measurements;

comparing the parameter determined through actual measurements, in conjunction with the confidence factor, to the reference composite curve for identifying underperformance of the pumping system;

calculating a pump performance index (PPI) based on a ratio of the parameter determined through actual measurements and the reference composite curve;

storing PPI values and confidence factor values taken at periodic intervals; and automatically providing an alert when a combination of PPI values and confidence factor values satisfies underperformance criteria.

2. The method as recited in claim 1, wherein creating comprises creating the reference composite curve based on test data for an electric submersible pumping system.

3. The method as recited in claim 2, wherein the electric submersible pumping system has a plurality of pump sections.

4. The method as recited in claim 1, wherein the satisfaction of underperformance criteria comprises crossing a threshold.

5. The method as recited in claim 1, wherein determining comprises utilizing performance related data on a real time basis.

6. The method as recited in claim 1, wherein determining comprises utilizing performance related data on an episodic basis.

7. The method as recited in claim 1, wherein determining comprises utilizing performance related data on both a real time and episodic basis.

8. A method of identifying underperforming pumping systems, comprising:

comparing a measured parameter of a pumping system to a reference parameter of the pumping system;

utilizing a confidence factor to facilitate accurate determination of underperformance of the pumping system;

deriving pump performance index (PPI) values over time by determining the ratio of the measured parameter to the reference parameter versus time; and determining a plurality of confidence factor values corresponding to the PPI values.

9. The method as recited in claim 8, further comprising storing the PPI values and the confidence factor values for use in determining when the pumping system performance satisfies underperformance criteria.

10. The method as recited in claim 9, wherein the satisfaction of underperformance criteria comprises crossing a threshold.

11. The method as recited in claim 9, further comprising alerting an operator when the pumping system performance satisfies underperformance criteria.

12. The method as recited in claim 8, further comprising determining the measured parameter based on real time data.

13. The method as recited in claim 8, further comprising determining the measured parameter based on episodic data.

14. A method of identifying underperforming pumping systems, comprising:

comparing a measured parameter of a pumping system to a reference parameter of the pumping system;

utilizing a confidence factor to facilitate accurate determination of underperformance of the pumping system; and determining the measured parameter based on a combination of real time data and episodic data.

15. The method as recited in claim 14, wherein the reference parameter is based on actual testing of the pumping system.

16. The method as recited in claim 14, wherein comparing comprises comparing a measured lift of an electric submersible pumping system to a reference lift of the electric submersible pumping system.

17. The method as recited in claim 14, further comprising providing the reference parameter in the form of a composite tested curve for pumping system performance.

18. A method comprising:

testing each pump of a pump unit prior to use of the pump unit in a submersible pumping system to determine a reference parameter for each pump, the testing comprising determining lift data for each pump of the pump unit; and creating a composite reference parameter based on combining reference parameters determined for each pump, wherein creating comprises summing the lift data from each pump of the pump unit to determine the composite reference parameter.

19. The method as recited in claim 18, wherein testing further comprises determining flow rate for each pump of the pump unit.

20. The method as recited in claim 19, further comprising averaging the flow rates from each pump of the pump unit to determine another composite reference parameter.

21. The method as recited in claim 18, wherein testing further comprises determining power for each pump of the pump unit.

22. The method as recited in claim 21, further comprising summing the power from each pump of the pump unit to determine another composite reference parameter.

23. The method as recited in claim 18, further comprising determining measured parameters during actual use of the pumping system for comparison to the composite reference parameter over time.

24. The method as recited in claim 23, further comprising providing a confidence factor based on the methodology used to determine measured parameters.

* * * * *